US010913296B2

(12) United States Patent
Puttini

(10) Patent No.: US 10,913,296 B2
(45) Date of Patent: Feb. 9, 2021

(54) PRINTING ASSEMBLY FOR DIGITAL PRINTING ON A CONTINUOUS METAL STRIP

(71) Applicant: GLOBUS S.r.l., Turin (IT)

(72) Inventor: Giacomo Puttini, Turin (IT)

(73) Assignee: GLOBUS S.r.l., Turin (IT)

( * ) Notice: Subject to any disclaimer, the term of this patent is extended or adjusted under 35 U.S.C. 154(b) by 0 days.

(21) Appl. No.: 16/516,338

(22) Filed: Jul. 19, 2019

(65) Prior Publication Data

US 2020/0031146 A1 Jan. 30, 2020

(30) Foreign Application Priority Data

Jul. 25, 2018 (IT) ..... 102018000007488

(51) Int. Cl.
*B41J 13/00* (2006.01)

(52) U.S. Cl.
CPC ..... *B41J 13/0009* (2013.01)

(58) Field of Classification Search
CPC ..... B41J 13/0009; B41J 15/048; B41J 3/413; B41J 15/046; B65H 2701/173; B65H 23/192; B65H 2301/3112; B65H 2801/15; B65H 23/188; B41M 5/0047; B41M 5/0058
USPC ..... 347/16
See application file for complete search history.

(56) References Cited

U.S. PATENT DOCUMENTS 1,960,513 A 5/1934 Arthur
3,955,737 A * 5/1976 Traise ..... B41F 13/02 226/108
2003/0019116 A1* 1/2003 DeWall ..... G01B 3/1041 33/42
2003/0126962 A1* 7/2003 Bland ..... B65H 35/0006 83/13
2006/0125899 A1* 6/2006 Cornish ..... B41J 3/407 347/104
2010/0194814 A1* 8/2010 Izawa ..... B41J 11/425 347/16

(Continued)

FOREIGN PATENT DOCUMENTS

DE 102010049258 A1 4/2012
JP H08197138 A 8/1996

(Continued)

OTHER PUBLICATIONS

Italian Search Report dated Apr. 9, 2019. 9 pages.

*Primary Examiner* — Huan H Tran
*Assistant Examiner* — Alexander D Shenderov
(74) *Attorney, Agent, or Firm* — RMCK Law Group, PLC

(57) ABSTRACT

A printing assembly for digital printing on a continuous metal strip, including: a digital printing unit having a printing area and a conveyor belt arranged for advancing the continuous metal strip in a longitudinal direction through the printing area, an inlet guide unit located upstream of the printing unit and configured to guide the continuous metal strip along a path comprising at least one first movable bend which is freely movable in the longitudinal direction, and an outlet guide unit located downstream of the digital printing unit and configured to guide the continuous metal strip along a path comprising at least one second movable bend which is freely movable in the longitudinal direction.

10 Claims, 3 Drawing Sheets

(56) References Cited

U.S. PATENT DOCUMENTS

| | | | | |
|---|---|---|---|---|
| 2013/0284846 | A1* | 10/2013 | Turner | B65H 23/188<br>242/419.5 |
| 2014/0260481 | A1* | 9/2014 | Umlauf | B21D 3/12<br>72/164 |
| 2016/0052740 | A1* | 2/2016 | Yamamoto | B41J 15/046<br>347/104 |

FOREIGN PATENT DOCUMENTS

| | | | |
|---|---|---|---|
| JP | 2007301816 | A | 11/2007 |
| WO | 2017098377 | A1 | 6/2017 |

* cited by examiner

PRINTING ASSEMBLY FOR DIGITAL PRINTING ON A CONTINUOUS METAL STRIP

CROSS-REFERENCE TO RELATED APPLICATION

This application claims priority to Italian Patent Application No. 102018000007488 filed Jul. 25, 2018. The disclosure of the above application is incorporated herein by reference in its entirety.

FIELD OF THE INVENTION

The present invention relates in general to systems for surface treatment of continuous metal strips, for example, of steel or aluminum.

More precisely, the invention relates to a printing assembly for digital printing on continuous metal strips.

DESCRIPTION OF THE PRIOR ART

Digital printing by means of inkjet printers is becoming increasingly widespread in many technical fields. The growing popularity of digital printers derives mainly from the fact that they allow high-definition polychromatic printing on various types of objects without any limit on the printing pattern, and that they allow variation of the printing pattern in real time without requiring operations to re-equip the machine.

Digital printers normally comprise a plurality of printing bars, each with a respective color. The product to be printed is made to advance through a printing area, and the printing bars extend in a direction transverse to the direction of movement of the product to be printed.

One of the problems of digital printing is to ensure precise positioning of the pieces to be printed with respect to the print-heads while the products are fed through the digital printer. If the product to be printed does not remain centered in the transverse direction during its movement, the definition of the printed image is compromised. In general, to obtain a good printing definition, the positioning tolerance in the transverse direction of the piece during its movement through the printing area must be less than 0.02 mm.

Currently, there are various types of systems for digital printing on individual pieces, such as, for example, ceramic tiles and rigid or semi-rigid panels, for example, of plastic, wood, metal, etc.

When the piece to be printed has defined dimensions, generally there are no problems in ensuring the centering of the piece during its movement through the digital printer.

Machines for digital printing on continuous strips are also known. However, in the current state-of-the-art, it is only possible to perform digital printing on continuous strips made of very flexible materials, such as, for example, fabrics or thin films of plastic material. Indeed, current solutions can only ensure the necessary definition of printing on continuous strips if the continuous strips can be retained with high precision while advancing in the longitudinal direction, without tensions that could compromise the precision of positioning.

Currently in the state-of-the-art, solutions for digital printing on continuous metal strips, for example with a thickness from 0.05 mm up to 1 mm and above, are not available. In fact, during their movement in the longitudinal direction, continuous metal strips are subjected to transverse forces that tend to cause displacements in the transverse direction of an entity greater than the tolerance (0.02 mm) necessary to obtain a good printing definition. Even the use of centering devices does not ensure the precision required for quality printing.

OBJECT AND SUMMARY OF THE INVENTION

The object of the present invention is to provide a printing assembly for digital printing on continuous metal strips, for example, of aluminum or steel, with a thickness of 0.05 mm up to 1 mm and above.

According to the present invention, this object is achieved by a digital printing assembly having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
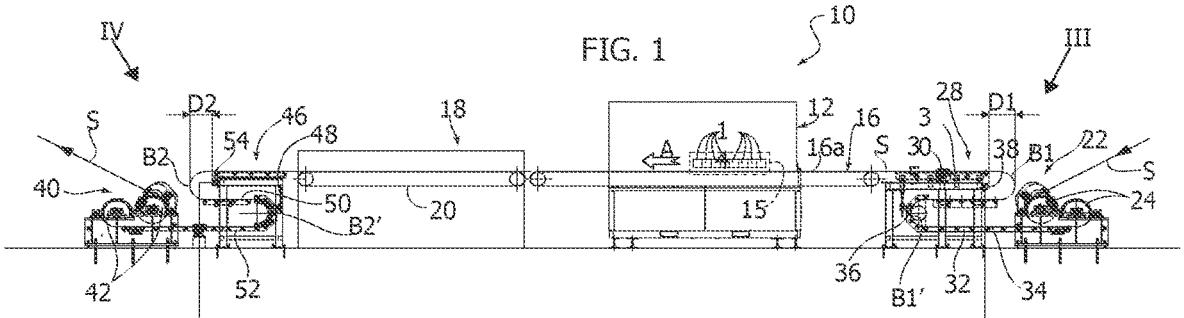
FIG. 1 is a schematic side view of a digital printing assembly according to the present invention.
Figure 2:
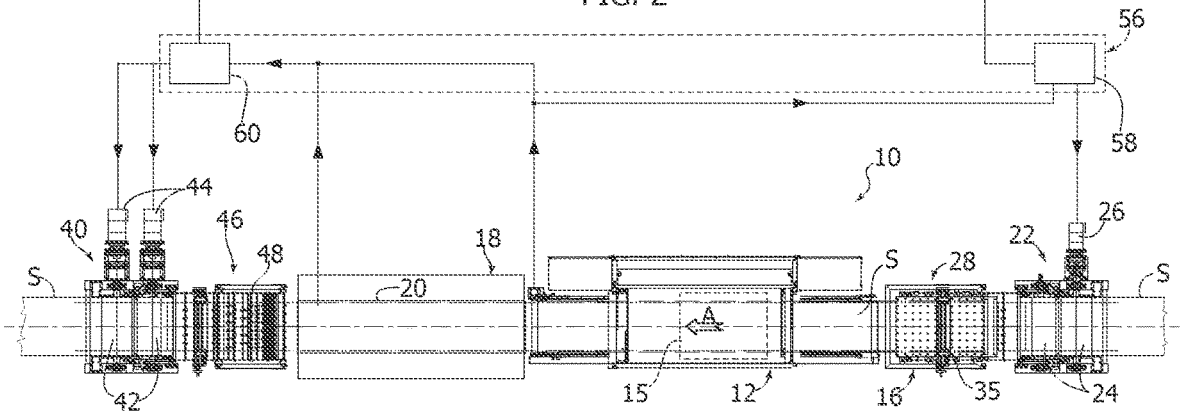
FIG. 2 is a schematic plan view of the digital printing assembly of FIG. 1, and FIGS. 3 and 4 are schematic side views on an enlarged scale of the parts indicated by the arrows III and IV shown in FIG. 1.
Figure 3:
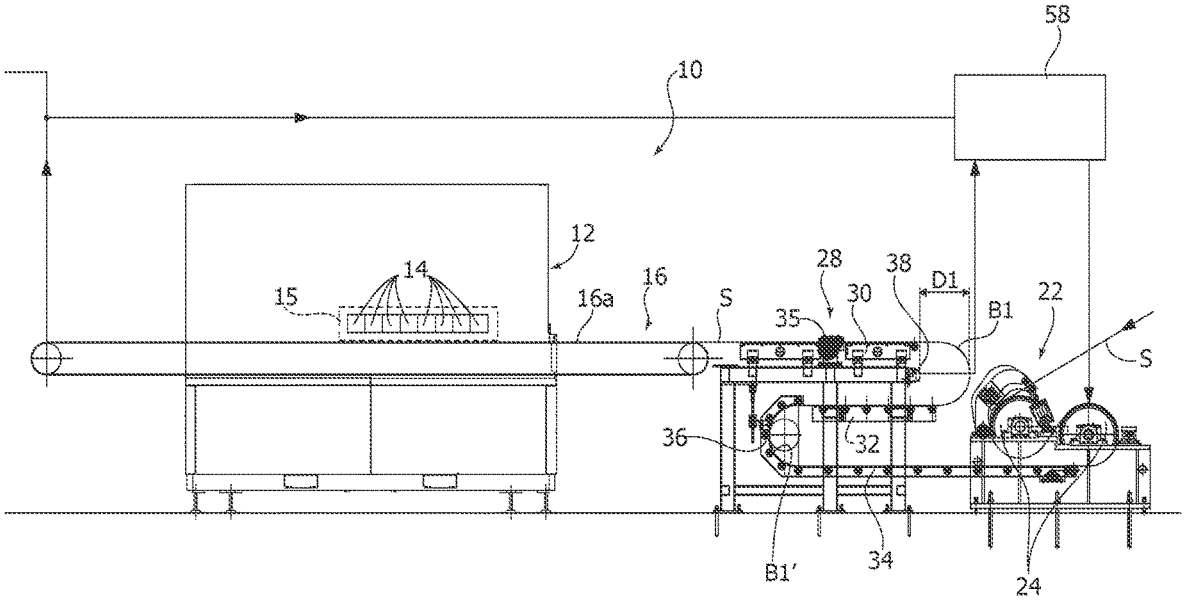
Figure 4:
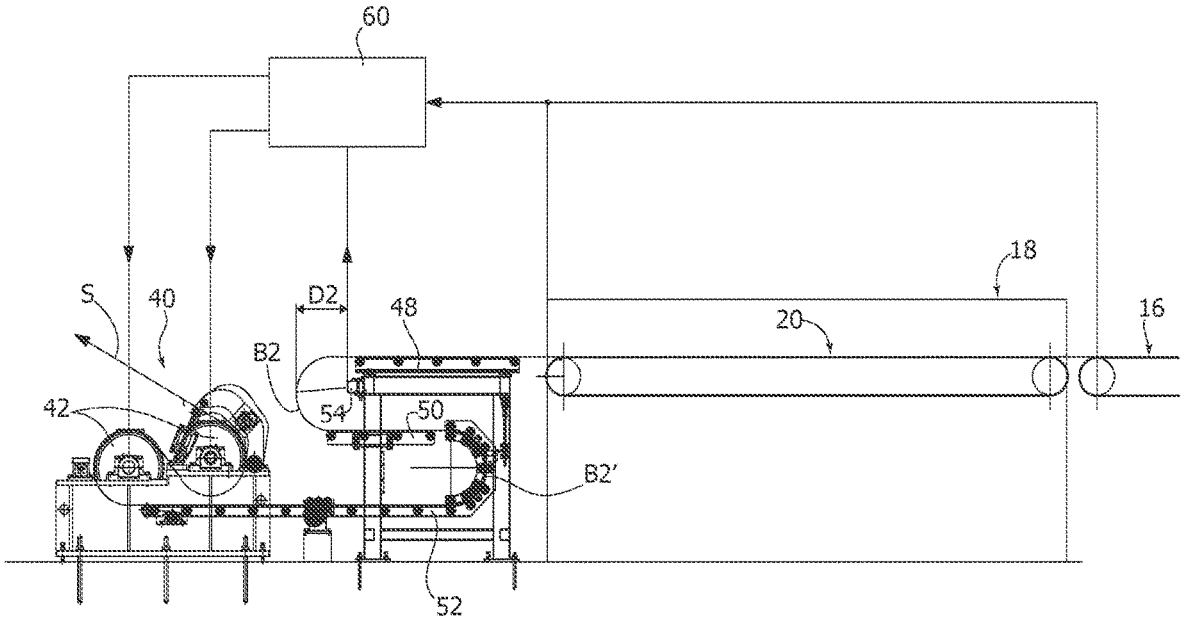

With reference to the figures, numeral 10 indicates a printing assembly for digital printing on a continuous metal strip S. The continuous metal strip S can be of any metal material, such as, for example, steel or aluminum, and can have a thickness from 0.05 mm up to 1 mm or above, and a width that can be in the order of 300-1800 mm. The continuous metal strip S has an indefinite length along its longitudinal axis. The continuous metal strip S may come from a reel or an in-line work station, for example, a painting station.

The printing assembly 10 comprises a digital printing unit 12 comprising a plurality of printing bars 14 that define a printing area 15. The digital printing unit 12 comprises a conveyor belt 16 arranged to support and advance the continuous metal strip S along a longitudinal direction A through the printing area 15 of the digital printing unit 12. The conveyor belt 16 may have an upper horizontal branch **16*a* connected to a suction source, to retain—by means of suction—the continuous metal strip S during its passage through the digital printing unit 12**.

Downstream of the digital printing unit 12, a section can be arranged for drying the printed inks according to the nature of the inks themselves; after this, a surface treatment unit can be arranged, for example, to apply a protective layer on the printed surface of the continuous metal strip S. The ink treatment section 18 may have a respective conveyor belt 20 to support and advance the continuous metal strip S in the longitudinal direction.

The printing assembly 10 may comprise an inlet pull bridle 22 arranged to feed the continuous metal strip S towards the digital printing unit 12. The inlet pull bridle 22 may comprise two rollers 24 rotatable about respective parallel axes. At least one of the rollers 24 of the inlet pull bridle 22 can be driven in rotation by an electric motor 26. The continuous metal strip S can be wound onto the rollers 24 of the inlet pull bridle 22 according to a generally S-shaped path. The motor 26 of the inlet pull bridle 22 can regulate the feeding speed of the continuous metal strip S in the inlet section of the printing assembly 10.

An inlet guide unit 28 is located downstream of the inlet pull bridle 22. The inlet guide unit 28 guides the continuous metal strip S between the inlet pull bridle 22 and the inlet section of the conveyor belt 16. The inlet guide unit 28 guides the continuous metal strip S along a path comprising at least one first movable bend B1, freely movable in the longitudinal direction A. Along the first movable bend B1 the continuous metal strip S is bent along a substantially U-shaped semicircular trajectory. In one possible embodiment, the inlet guide unit 28 may guide the continuous metal strip S along a generally S-shaped path including a first movable bend B1, freely movable in the longitudinal direction A, and a first fixed bend B1', which is fixed in the longitudinal direction A. The first movable bend B1 and the first fixed bend B1' may have concavities opposite to each other.

In one possible embodiment, the inlet guide unit 28 may have a first sliding plane 30, a second sliding plane 32 and a third sliding plane 34, parallel to each other and spaced apart in the vertical direction, and along which the continuous metal strip S is movable in the path that goes from the inlet pull bridle 22 to the digital printing unit 12. The sliding surfaces 30, 32, 34 may be provided with idle rollers that support the continuous metal strip S in the S-shaped path. One or more of the sliding surfaces 30, 32, 34, for example, the upper sliding plane 30 can be a pneumatic support plane configured to support the corresponding section of the continuous metal strip S on an air cushion. The upper sliding plane 30 of the inlet guide unit 28 may be aligned with the upper horizontal branch 16*a* of the conveyor belt 16.

The upper sliding plane 30 of the inlet guide unit 28 can be provided with a centering device 35 which guides the side edges of the continuous metal strip S, and carries out the centering of the continuous metal strip S in the transverse direction with respect to the digital printing unit 12.

A first distance sensor 38 may be provided to measure the distance D1 between the first movable bend B1 of the continuous metal strip S in the longitudinal direction A with respect to a fixed reference point. The distance sensor 38 may be a non-contact sensor, for example, a laser distance sensor, ultrasonic distance sensor, etc.

The inlet guide unit 28 may be provided with a curved guide section 36 to guide the continuous metal strip S between the second and third sliding planes 32, 34 and to impart the first fixed bend B1' to the continuous metal strip S.

The printing assembly 10 may comprise an outlet pull bridle 40 located at the outlet of the printing assembly 10, and arranged to advance the continuous metal strip S from the outlet of the printing assembly 10 towards a downstream apparatus, which can be a winding reel for collecting the continuous metal strip S in a bobbin, or an apparatus for carrying out further processing on the continuous metal strip S. The outlet pull bridle 40 may comprise two rollers 42 rotatable about respective axes parallel to each other, and the continuous metal strip S can be wound around the rollers 42 according to a generally S-shaped path. At least one of the rollers 42 of the outlet pull bridle 40 can be rotated by means of a respective electric motor 44. In the illustrated example, both rollers 42 are driven into rotation by respective electric motors 44.

The printing assembly 10 comprises an outlet guide unit 46 located downstream of the digital printing unit 12 and upstream of the outlet pull bridle 14. The outlet guide unit 46, similarly to the inlet guide unit 28, guides the continuous metal strip S along a path comprising at least one second movable bend B2, which is freely movable in the longitudinal direction A. The outlet guide unit 46 can guide the continuous metal strip S along a generally S-shaped path comprising a second movable bend B2, freely movable in the longitudinal direction A and a second fixed bend B2', which is fixed in the longitudinal direction A. The second movable bend B2 and the second fixed bend B2' may have opposite concavities to each other.

The outlet guide unit 46 may comprise a first sliding plane 48, a second sliding plane 50 and a third sliding plane 52 parallel to each other and spaced apart in a vertical direction. The third bend B3 extends between the first sliding plane 48 and the second sliding plane 50, and the fourth bend B4 extends between the second sliding plane 50 and the third sliding plane 52. The sliding surfaces 48, 50, 52 may be provided with idle rollers. One or more of the sliding surfaces 48, 50, 52, for example, the upper sliding surface 48, may be a pneumatic cushion plane. The upper sliding surface 48 may be aligned with the conveyor belt 20 of the ink treatment section 18.

The printing assembly 10 may comprise a second distance sensor 54 arranged to detect the distance D2 in the longitudinal direction A of the second movable bend B2 with respect to a fixed reference point. The second distance sensor 54 may be a non-contact sensor, for example, a laser distance sensor, ultrasonic distance sensor, etc.

The printing assembly 10 may comprise an electronic control system 56 programmed to receive information from distance sensors 38 and 54 and to control the inlet pull bridle 22 and the outlet pull bridle 40 so as to maintain the distance D1 of the first movable bend B1 and the distance D2 of the second movable bend B2 within predetermined ranges. The electronic control system 56 may comprise a first PLC 58 associated with the first distance sensor 38 and with the inlet pull bridle 22, and a second PLC 60 associated with the second distance sensor 54 and with the outlet pull bridle 40. The electronic control system 56 can also receive information on the speed of the conveyor belt 16 of the digital printing unit 12 and of the conveyor belt 20 of the possible ink treatment section 18.

When the distance D1 of the first movable bend B1 approaches a predetermined minimum value, the electronic control system 56, by means of the first PLC 58 controls the motor 26 of the first bridle 22 and increases the speed of the continuous metal strip S upstream of the inlet guide unit 28. When the distance D1 of the first movable bend B1 approaches a predetermined maximum value, the electronic control system 56 controls the motor 26 of the inlet pull bridle 22 to slow down the feeding speed of the continuous metal strip S upstream of the inlet guide unit 28.

Correspondingly, when the distance D2 of the second movable bend B2 approaches a predetermined minimum value, the electronic control system 56, by means of the second PLC 60, controls the motors 44 of the outlet pull bridle to reduce the feeding speed of the continuous metal strip S downstream of the outlet guide unit 46. When the distance D2 of the second movable bend B2 approaches a predetermined maximum value, the electronic control system 56 controls the motors 44 of the outlet pull bridle 40 to increase the feeding speed of the continuous metal strip S downstream of the outlet guide unit 46.

During operation, the straight section of the continuous metal strip S between the first movable bend B1 and the second movable bend B2 advances in the longitudinal direction A through the digital printing unit 12 with a substantially zero tension in the longitudinal direction. In fact, the first and second bends B1, B2 being freely movable in the longitudinal direction A, cancel the longitudinal tensions on the section of the continuous metal strip S comprised between the movable bends B1, B2. Cancellation of the longitudinal tensions on the continuous metal strip S during its advancement through the digital printing unit ensures a high precision of the positioning of the continuous metal strip S with respect to the digital printing unit 12 and ensures a high quality of the printing definition.

To further improve the printing quality, a smoothing unit could be provided, located upstream of the printing assembly 10 to eliminate undulations of the continuous metal strip S. Elimination of the undulations of the continuous metal strip upstream of the printing assembly allows reduction of the distance between the print-heads and the surface of the continuous metal strip (which ideally should be less than 2 mm).

In the attached drawings, the inlet and outlet movable bends have been indicated in a horizontal position, but it is understood that—within the scope of the present invention—there are alternative solutions in which the movable bends can be made in a vertical or inclined position.

Of course, without prejudice to the principle of the invention, the details of construction and the embodiments can be widely varied with respect to those described and illustrated, without thereby departing from the scope of the invention as defined by the claims that follow.

| LIST OF REFERENCE SYMBOLS | |
|---|---|
| printing assembly | 10 |
| continuous metal strip | S |
| digital printing unit | 12 |
| printing bar | 14 |
| printing area | 15 |
| conveyor belt | 16 |
| longitudinal direction | A |
| upper horizontal branch | 16a |
| ink treatment section | 18 |
| conveyor belt | 20 |
| inlet pull bridle | 22 |
| rollers | 24 |
| electric motor | 26 |
| inlet guide unit | 28 |
| first movable bend | B1 |
| first fixed bend | B1' |
| first sliding plane | 30 |
| second sliding plane | 32 |
| third sliding plane | 34 |
| centering device | 35 |
| curved guide section | 36 |
| first distance sensor | 38 |
| distance | D1 |
| outlet pull bridle | 40 |
| rollers | 42 |
| electric motors | 44 |
| outlet guide unit | 46 |
| second movable bend | B2 |
| second fixed bend | B2' |
| first sliding plane | 48 |
| second sliding plane | 50 |
| third sliding plane | 52 |
| second distance sensor | 54 |
| distance | D2 |
| electronic control system | 56 |
| first PLC | 58 |
| second PLC | 60 |

The invention claimed is:

1. A printing assembly for digital printing on a continuous metal strip, comprising:

a digital printing unit having a printing area and a conveyor belt arranged for advancing said continuous metal strip in a longitudinal direction through said printing area, an inlet guide unit located upstream of said digital printing unit and configured to guide said continuous metal strip along a first path comprising at least one first movable bend which is freely movable in said longitudinal direction, and an outlet guide unit located downstream of said digital printing unit and configured to guide said continuous metal strip along a second path comprising at least one second movable bend which is freely movable in said longitudinal direction.

2. The printing assembly according to claim 1, comprising an inlet pull bridle configured to advance said continuous metal strip upstream of said inlet guide unit and an outlet pull bridle configured to advance said continuous metal strip downstream of said outlet guide unit.

3. The printing assembly according to claim 2, comprising:

a first distance sensor arranged to measure a first distance in the longitudinal direction of said first movable bend with respect to a first fixed reference point and a second distance sensor arranged to measure a second distance in the longitudinal direction of said second movable bend with respect to a second fixed reference point, and an electronic control system programmed to receive information from said distance sensors and to control said inlet pull bridle and said outlet pull bridle so as to maintain the first distance of the first movable bend and the second distance of the second movable bend within predetermined ranges.

4. The printing assembly according to claim 1, wherein at least one of said inlet guide unit and said outlet guide unit is configured to guide said continuous metal strip along a substantially S-shaped path including a movable bend and a fixed bend.

5. The printing assembly according to claim 1, wherein at least one of said inlet guide unit and said outlet guide unit comprises a first sliding plane, a second sliding plane and a third sliding plane parallel to each other and spaced apart from each other in a vertical direction.

6. The printing assembly according to claim 5, wherein said first sliding plane is aligned with an upper horizontal branch of said conveyor belt of the digital printing unit.

7. The printing assembly according to claim 6, wherein the inlet guide unit comprises a centering device associated with the first sliding plane.

8. A method for digital printing on a continuous metal strip, comprising:

feeding the continuous metal strip in a longitudinal direction through a digital printing unit, guiding said continuous metal strip upstream of said digital printing unit along a first path comprising at least one first movable bend freely movable in said longitudinal direction, and guiding said continuous metal strip downstream of said digital printing unit along a second path comprising at least one second movable bend freely movable in said longitudinal direction.

9. The method according to claim 8, comprising measuring a distance of said first movable bend in a longitudinal direction of said first movable bend with respect to a fixed reference point and controlling a feeding speed of the continuous metal strip upstream of said first movable bend so as to maintain said distance within a predetermined range.

10. The method according to claim 8, comprising measuring a distance in the longitudinal direction of said second movable bend with respect to a fixed reference point and controlling a feeding speed of the continuous metal strip downstream of said second movable bend so as to maintain said distance within a predetermined range.

* * * * *